United States Patent [19]

Obradovic

[11] Patent Number: 4,819,460

[45] Date of Patent: Apr. 11, 1989

[54] WASHING MACHINE WITH DIRECT DRIVE SYSTEM

[75] Inventor: Ilija J. Obradovic, Belgrad, Yugoslavia

[73] Assignee: Emerson Electric Co., St. Louis, Mo.

[21] Appl. No.: 57,167

[22] Filed: Jun. 2, 1987

[30] Foreign Application Priority Data

Jun. 18, 1986 [YU] Yugoslavia ..... 13214/86

[51] Int. Cl.[4] ..... D06F 17/08; D06F 23/04; D06F 37/40

[52] U.S. Cl. ..... 68/23.7

[58] Field of Search ..... 68/23 R, 23.6, 23.7, 68/174

[56] References Cited

U.S. PATENT DOCUMENTS 2,656,702 10/1953 Chapin ..... 68/23.7 X
3,216,226 11/1965 Alger et al. ..... 68/23 R
3,216,227 11/1965 Alger et al. ..... 68/23.7
3,324,690 6/1967 Button ..... 68/23.7

FOREIGN PATENT DOCUMENTS 58262 5/1977 Japan ..... 68/23 R

*Primary Examiner*—Philip R. Coe
*Attorney, Agent, or Firm*—Polster, Polster and Lucchesi

[57] ABSTRACT

A washing machine includes an agitator and a perforated tub which are rotatable about their coincident longitudinal axes. A switched reluctance motor directly drives the agitator during the wash cycle and both the agitator and the tub during the spin cycle. The drive mechanism is gearless so that the agitator and tub revolve at exactly the same rate as the motor shaft. The sole axial support of the tub and the agitator is the motor, so that motor is provided with heavy duty bearings to carry the load and is supported in line with the axis of rotation by a four arm frame.

10 Claims, 2 Drawing Sheets

WASHING MACHINE WITH DIRECT DRIVE SYSTEM

BACKGROUND OF THE INVENTION

This invention relates to laundering apparatus, and more particularly to a simplified direct drive system for laundering apparatus.

Many conventional washing machines are available which utilize a relatively slow back-and-forth motion of an agitator during a wash cycle and a much higher unidirectional motion of the agitator and tub during a spin cycle in which water is removed from the tub of the washer. Often this spin cycle can reach speeds of 600 r.p.m. or even higher while the speed during the agitation cycle is much, much lower. Conversely, the torque requirements during agitation are much higher than during the spin cycle.

Heretofore, a single unidirectional motor has been used to provide the motive power for both these cycles. The motor in these cases is connected to the agitator and to the washing machine tub by means of a relatively complex transmission. The physical dimensions of such a transmission in combination with the motor tend to be rather large. As a result, the motor is usually positioned considerably out-of-line with the axis of the drive shaft of the laundry machine. Furthermore, severe demands are made on the transmission during the agitation cycle due to the reversal of direction of motion. As a result these devices may have a relatively short life.

SUMMARY OF THE INVENTION

Among the various objects and features of the present invention may be noted the provision of an improved, yet simplified drive for washing machines.

Another object of the present invention is the provision of such a drive system which eliminates the need for a complex transmission.

A third object of the present invention is the provision of such a drive system with an extended life.

Other objects and features will be in part apparent and in part pointed out hereinafter.

In a first embodiment, the washing machine of the present invention includes a rotatable member adapted for contact with clothes to be washed, which rotatable member is rotatable about its longitudinal axis. A switched reluctance motor is cyclically operable in first and second opposed directions at a first relatively slow speed to agitate the clothes being washed and is operable continuously in the first direction at a second, relatively high speed. The motor has a stator and a rotor, the rotor carrying a shaft defining the longitudinal axis of the motor. The longitudinal axes of the rotatable member and of the motor are coincident. The machine also includes a frame to which the motor is securely fastened, and a drive mechanism for connecting the rotatable member and the motor shaft so that rotation of the motor shaft causes corresponding rotation of the rotatable member.

In a second embodiment of the present invention, a washing machine includes a tub rotatable about its longitudinal axis for holding clothes to be washed and the like, and a switched reluctance motor having a stator and a rotor. The rotor carries a shaft defining the longitudinal axis of the motor. The longitudinal axes of the tub and the motor are coincident. The motor is securely fastened to a frame. A single shaft is connected to the tub and removably connected to the motor, which single shaft extends along the longitudinal axes of the tub and the motor. The shaft is substantially the only axial support for the tub so that the weight of the tub is substantially wholly supported by the motor.

BRIEF DESCRIPTION OF THE DRAWINGS

Similar reference characters indicate similar parts throughout the several views of the drawings.

DESCRIPTION OF THE PREFERRED EMBODIMENTS

Figure 1:
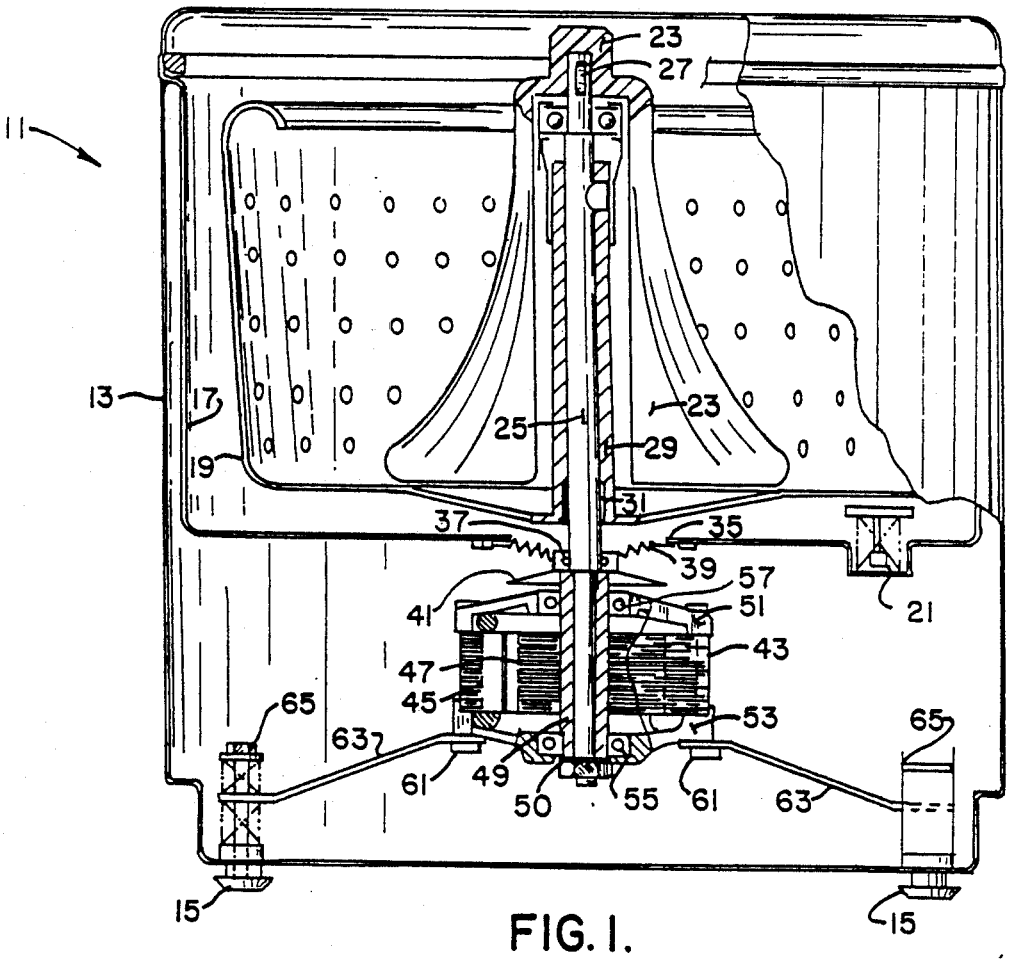
FIG. 1 is a front elevation, with parts broken away for clarity, of the washing machine of the present invention.

Washing machine 11 of the present invention includes a cabinet 13 supported on a floor or other surface by a plurality of feet 15. Cabinet 13 has fixedly secured thereto a conventional enclosing tub 17 which holds the water during the washing process. A perforated tub 19 is disposed inside enclosing tub 17 and is mounted as described below for movement with respect to the enclosing tub. More particularly, perforated tub 19 spins around its longitudinal axis during the spin-cycle of the washing machine 11 to remove water from the interior of the tub. An electromechanical brake 21 is provided to prevent relative motion of perforated tub 19 with respect to stationary enclosing tub 17 if needed. For example, such brakes are useful if the inertia of perforated tub 19 together with that of the laundry is not sufficient to hold the perforated tub relatively motionless during agitation.

An agitator 23 is axially mounted in perforated tub 17 to impart the agitating back-and-forth motion to the water and laundry in perforated tub 19 during the agitation cycle. A main shaft 25 extends along the longitudinal axes of perforated tub 19 and agitator 23 to impart the desired back-and-forth motion and spin cycle motion described above. A wedge 27 disposed at the top of main shaft 25 fixes the agitator with respect to the main shaft so that rotation of main shaft 25 causes agitator 23 to rotate in the same amounts and directions as the main shaft.

Main shaft 25 has a tubular sleeve 29 disposed therearound. Tubular sleeve 29 is fixedly secured to perforated tub 19 so that rotation of sleeve 29 causes corresponding rotation of perforated tub 19. A plastic bearing 31 is disposed at the bottom of tubular sleeve 29 to allow relative rotation between main shaft 25 and the tubular sleeve. Similarly, a bearing 33 (FIG. 2) is also disposed at the top of tubular sleeve 29 to permit such relative rotation. As is explained below, main shaft 25 rotates through a given angle in the back-and-forth direction to move the agitator 23 correspondingly, while tubular sleeve 29 and perforated tub 19 remain stationary.

Stationary tub 17 has a central opening 35 through which main shaft 25 extends. More particularly, main shaft 25 extends through a sealing member 37 surrounded by a sealing membrane 39 which is connected to the periphery of central opening 35. A conical shield 41 is disposed below sealing member 37 to deflect water away from the bearings of a motor 43 in the event that sealing member 37 or sealing membrane 39 are damaged.

Motor 43 is a doubly salient switched reluctance motor operating under suitable electronic control (not shown) to provide both the agitation motion and the spin motion for agitator 23 and perforated tub 19. Such motors are capable of producing very high torque at low speed, which feature is used for the back-and-forth motions during the washing cycle. Such a motor is also capable of driving the perforated tub 19 at high speeds at a reduced torque. Driving motor 43 is located under the enclosing tub 17 and has the same axis of rotation as the main rotating parts of laundry machine 11. Motor 43 includes stator laminations 45 along with the associated coils and a rotor 47 carrying a hollow shaft 49. Main shaft 25 extends through hollow motor shaft 49 and is suitably secured thereto by a washer and nut combination 50 or other suitable means.

Hollow shaft 49 is supported in a pair of end shields 51 and 53 of the motor by heavy duty bearings 55 and 57. The upper motor bearing 57 together with lower motor bearing 55 and both end shields must be capable of supporting all the dynamic forces produced during the wash and spinning cycles of the washing machine 11 because they form the sole support for the rotating parts of the washing machine and the laundry contained therein.

Motor 43 is secured by means of a plurality of bolts 61 to a relatively rigid frame made up of four support arms 63. Support arms 63 are, secured by suitable damping connectors 65 to cabinet feet 15 as shown.

Figure 2:
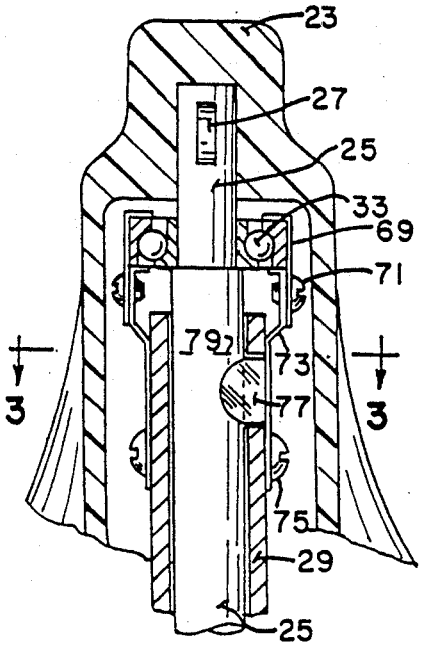
FIG. 2 is a view on an expanded scale of the upper portion of the drive system of the present invention.

Turning now to FIG. 2, tubular sleeve 29 is held on to main shaft 25 at its upper end by bearings 33. Bearings 33 are held in a collar 69 which is secured by means of suitable threaded fasteners 71, or welding or the like, to a connector 73 which is in turn secured by other threaded fasteners 75 or the like to tubular sleeve 29 itself.

Figure 3:
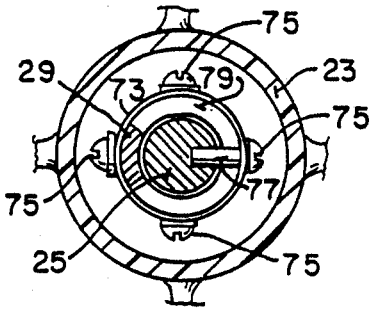
FIG. 3 is a cross-sectional view taken along lines 3—3 of FIG. 2.

Main shaft 25 has a pin 77 secured against rotation with respect thereto which rides in a slot 79 in tubular sleeve 29 during the agitation cycle. As can be seen in FIG. 3, slot 79 extends approximately five radians (approximately 280 degrees) around the tubular sleeve so that agitation motion of approximately 2.5 radians in each direction is allowed by this construction without moving the perforated tub. On the other hand, during the spin cycle, main shaft 25 rotates to a position in which pin 77 contacts tubular sleeve 29 and begins carrying the tubular sleeve. That is, rotation of main shaft 25 past the angle allowed by slot 79 causes tubular sleeve 29 to begin rotating with main shaft 25. When this occurs, rotatable tub 19 begins to rotate with the main shaft as well due to the fact that the rotatable tub is carried by tubular sleeve 29.

With the present invention, only a single shaft, namely main shaft 25 is used for torque transmission between motor 43 and the rotating parts (tub 19 and agitator 23) of the laundry machine. Moreover, motor 43 is used as the frame for all the rotating parts in the laundry machine. This frame includes not only the motor 43 with its end shields 51 and 53 but also the four support arms 63 connected thereto in a rigid connection. Although the particular circuitry for controlling motor 43 is not part of the present invention, it should the appreciated that the present invention is capable of accepting drive commands from such circuitry to cause the backand-forth rotation of agitator 23 in an amplitude of up to 2.5 radians in either direction at any desired frequency within the capability of the motor. Moreover, the present drive system is capable of being accelerated at any desired rate within the capability of the motor in a single direction to cause main shaft 25 to begin carrying tubular sleeve 29 and perforated tub 19 to the desired speed in the spin cycle.

Figure 5:
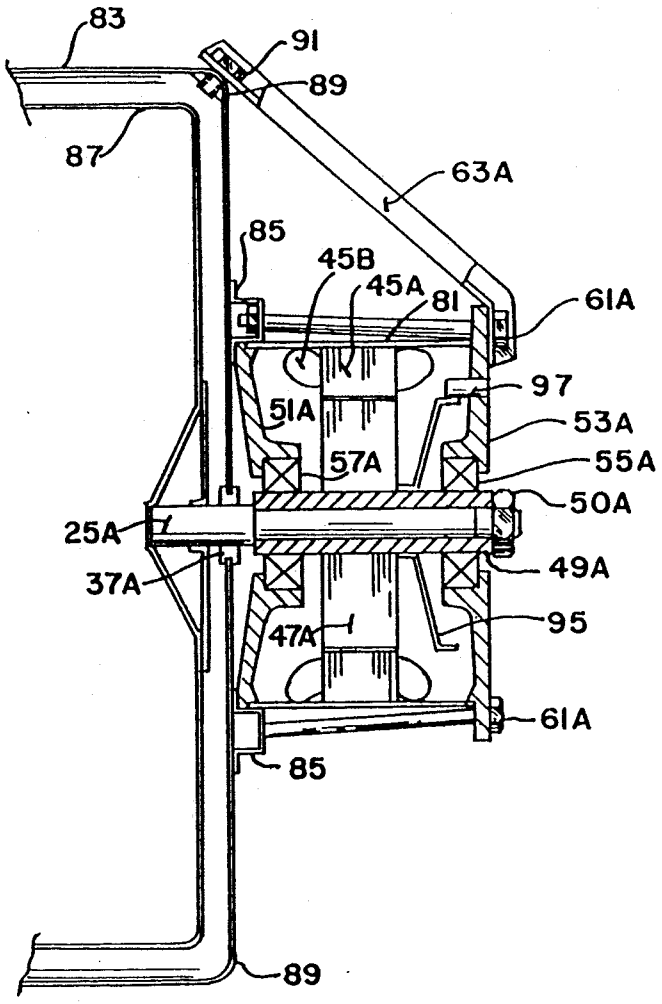
FIG. 5 is a sectional view taken generally along lines 5—5 of FIG. 4.
Figure 4:
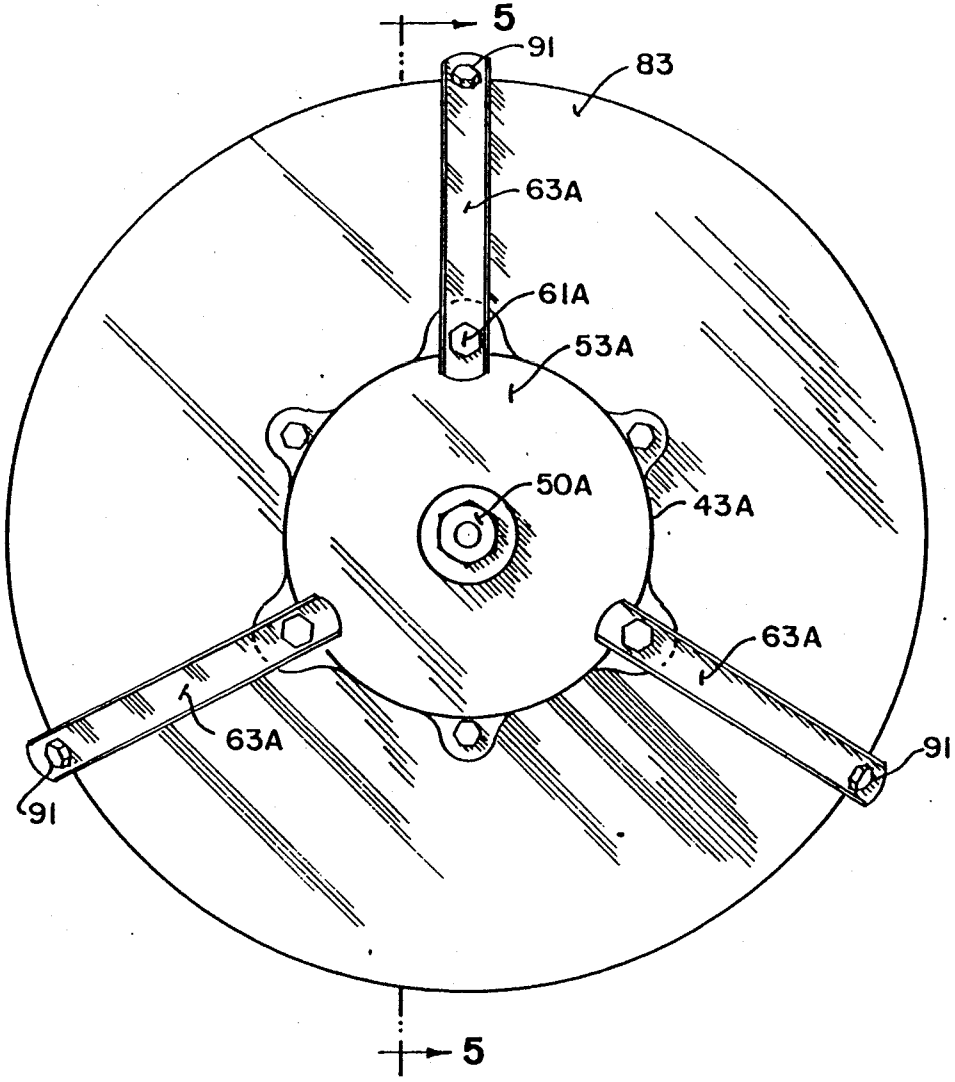
FIG. 4 is a rear elevation of an alternative embodiment of the washing machine of the present invention.

A second embodiment of the laundry apparatus of the present invention is illustrated in FIGS. 4 and 5. For convenience in the embodiment of FIGS. 4 and 5 the parts closely corresponding to parts in the first embodiment are labeled with the corresponding number with the suffix A while parts that differ in any significant respect are given new numbers in FIGS. 4 and 5.

Motor 43A of the second embodiment, like motor 43 of the first embodiment, includes a lamellar iron stator 45A and a suitable winding 45B inside a housing 81. End shields 51A and 3A function as bearing supports for bearings 57A and 55A. The end shields are firmly fixed to the back of the washing machine vessel 83 by means of a plurality of holders 85 which are welded to vessel 83. Threaded fasteners 61A secure end shields 51A and 53A to the holders 85, which insure that the entire motor is firmly tightened to, the back surface of washing machine vessel 83. Rigidity of the structure is necessary, especially during high speed centrifuging of a drum 87 disposed in the vessel. This rigidity is achieved according to the present invention by also connecting rear end shield 53A to the welded nosing edge 89 of vessel 83. More particularly, this connection is made by supports 63A connected to nosing edge 89 in a plurality of places as illustrated in FIG. 4 by means of threaded fasteners 61A and additional screws 91.

The rotor 47A of motor 43A consists of a lamellar iron core without windings and a hollow, tubular shaft 49A which rides on bearings 55A and 57A. The hollow shaft is provided to allow easier assembly and repairing of the washing machine. With this construction, the shaft 25A of washing machine drum 87 is simply placed in the hollow motor shaft 49A and tightened in place with nut 50A. A gasket 37A placed in the wall of washing vessel 83 prevents penetration of water into the motor area.

A rotor position indicator is fixed to rotor shaft 49A. This consists of a serrated tin part 95 with the same number of teeth as rotor 47A and of a position indicator 97 which converts the position of teeth and spacings between the teeth into logical impulses "0" and "1", in a conventional manner which is not the subject of the present invention. With this construction, the present washing machine may be operated at low speeds in alternating directions in order to achieve better washing of the laundry and then revolved at a higher revolution speed to rinse the laundry and remove the water with the help of centrifugal force.

In view of the above it will be seen that the various objects and features of the present invention are achieved and other advantageous results obtained. As various changes could be made in the above constructions and methods without departing from the scope of the invention, it is intended that all matter contained in the above description or shown in the accompanying drawings shall be interpreted as illustrative and not in a limiting sense.

What is claimed is:

1. A washing machine comprising:

a rotatable member adapted for contact with clothes to be washed, said rotatable member being rotatable about its longitudinal axis;

a switched reluctance motor having a stator and a rotor, said rotor being cyclically operable in first and second opposed directions at a first relatively slow speed to agitate the clothes being washed and operable continuously in the first direction at a second, relatively high speed, said rotor carrying a motor shaft defining the longitudinal axis of the motor, said longitudinal axes of the rotatable member and of the motor being coincident;

a frame to which the motor is securely fastened, said rotor being rotatable with respect to the frame; and means for connecting the rotatable member and the motor shaft so that rotation of the motor shaft causes corresponding rotation of the rotatable member, cyclical operation of the rotor in the first and second opposed directions at a relatively low speed thereby causing agitation of the clothes being washed and continuous operation of the rotor in the first direction at the high speed thereby providing a spin cycle for the washing machine;

said motor shaft being hollow and the connecting means extending through the motor shaft.

2. The washing machine as set forth in claim 1 further including means for fixedly securing the connecting means to the hollow motor shaft on the side of the motor opposite the rotatable member.

3. The washing machine as set forth in claim 1 wherein the rotatable member is an agitator coaxially disposed in a perforated tub, said perforated tub being selectively rotatable about its longitudinal axis, including selective driving means coupled to the connecting means for driving the perforated tub to rotate when the motor is operating continuously in the first direction but allowing the tub to remain still when the motor is cyclically operating in the first and second opposed directions, said agitator rotating correspondingly about its longitudinal axis whenever the rotor is rotated.

4. The washing machine as set forth in claim 3 wherein the connecting means consists of a single shaft external of the agitator and the perforated tub.

5. A washing machine comprising:

a rotatable member adapted for contact with clothes to be washed, said rotatable member being rotatable about its longitudinal axis, said rotatable member being an agitator coaxially disposed in a perforated tub, said perforated tub being selectively rotatable about its longitudinal axis;

a switched reluctance motor cyclically operable in first and second opposed directions at a first relatively slow speed to agitate the clothes being washed and operable continuously in the first direction at a second, relatively high speed, said motor having a stator and a rotor, said rotor carrying a shaft defining the longitudinal axis of the motor, said longitudinal axes of the rotatable member and of the motor being coincident;

a frame to which the motor is securely fastened; and means for connecting the rotatable member and the motor shaft so that rotation of the motor shaft causes corresponding rotation of the rotatable member, said connecting means consisting of a single shaft external of the agitator and the perforated tub and selective driving means coupled to the single shaft for driving the perforated tub to rotate when the motor is operating continuously in the first direction but allowing the tub to remain still when the motor is cyclically operating in the first and second opposed directions;

the single shaft extending upwardly into the agitator, said selective driving means including a sleeve disposed around the single shaft inside the agitator, said sleeve being rotatable through at least a predetermined angle with respect to e single shaft, further including means for engaging the sleeve by the single shaft after a predetermined rotation of the single shaft with respect to the sleeve so that the sleeve is carried thereafter by the single shaft, said sleeve being secured to the perforated tub.

6. The washing machine as set forth in claim 3 wherein the connecting means is gearless so that the agitator and the motor shaft rotate at the same rate, the selective driving means including means for selectively driving the perforated tub at the same speed of rotation as the motor shaft.

7. A washing machine comprising:

a tub rotatable about its longitudinal axis for holding clothes to be washed and the like;

an agitator coaxially disposed in the tub;

a switched reluctance motor having a stator and a rotor, said rotor carrying a motor shaft defining the longitudinal axis of the motor, said longitudinal axes of the tub and the motor being coincident;

a frame to which the motor is securely fastened;

a single shaft connected to the tub and removably connected to the motor shaft, said single shaft extending along the longitudinal axes of the tub and the motor, said shaft being substantially the only axial support for the tub so that the weight of the tub is substantially wholly supported by the motor, said single shaft being secured to the agitator so that rotation of the motor shaft results in corresponding rotation of the agitator; and selective drive means for driving the tub to rotate when the motor is operated continuously in a first direction but allowing the tub to remain still when the motor is cyclically operated through a partial revolution in the first direction and a second, opposed direction.

8. A washing machine comprising:

a tub rotatable about its longitudinal axis for holding clothes to be washed and the like;

a switched reluctance motor having a stator and a rotor, said rotor carrying a motor shaft defining the longitudinal axis of the motor, said longitudinal axes of the tub and the motor being coincident;

a frame to which the motor is securely fastened;

a single shaft connected to the tub and removably connected to the motor, said single shaft extending along the longitudinal axes of the tub and the motor, said shaft being substantially the only axial support for the tub so that the weight of the tub is substantially wholly supported by the motor;

selective drive means coupled to the single shaft for driving the tub to rotate when the motor is operated continuously in a first direction but allowing the tub to remain still when the motor is cyclically operated through a partial revolution in the first direction and a second, opposed direction; and an agitator coaxially disposed in the tub, said single shaft extending upwardly into the agitator, wherein the selective driving means includes a sleeve disposed around the single shaft inside the agitator, said sleeve being rotatable through at least a predetermined angle with respect to the single shaft, further including means for engaging the sleeve by the single shaft after a predetermined rotation of the single shaft with respect to the sleeve so that the sleeve is carried thereafter by the single shaft, said sleeve being secured to the tub.

9. A washing machine comprising:

a tub rotatable about its longitudinal axis for holding clothes to be washed and the like;

an agitator coaxially disposed in the tub;

a switched reluctance motor having a stator and a rotor, said rotor carrying a motor shaft defining the longitudinal axis of the motor, said longitudinal axes of the tub and the motor being coincident;

a frame to which the motor is securely fastened;

a single shaft extending along the longitudinal axes of the tub and the motor, said single shaft being secured to the motor shaft and to the agitator so that rotation of the motor shaft results in corresponding rotation of the agitator; and selective drive means coupled to the single shaft for driving the tub to rotate when the motor is operated continuously in a first direction but allowing the tub to remain still when the motor is cyclically operated through a partial revolution in the first direction and a second, opposed direction.

10. The washing machine a set forth in claim 9 wherein the single shaft extends upwardly into the agitator and wherein the selective drive means includes a sleeve disposed around the single shaft inside the agitator, said sleeve being rotatable through at least a predetermined angle with respect to the single shaft, further including means for engaging the sleeve by the single shaft after a predetermined rotation of the single shaft with respect to the sleeve so that the sleeve is carried thereafter by the single shaft, said sleeve being secured to the perforated tub.

* * * * *

UNITED STATES PATENT AND TRADEMARK OFFICE

CERTIFICATE OF CORRECTION

PATENT NO. : 4,819,460

DATED : April 11, 1989

INVENTOR(S) : Ilija J. Obradovic

It is certified that error appears in the above-identified patent and that said Letters Patent is hereby corrected as shown below: Title page:

Abstract, line 9, "that" should be ---the---.

Column 4, line 3, "backand-forth" should be ---back-and-forth---.

Column 4, line 21 "3A" should be ---53A---.

Column 4, line 27, "to," should be ---to---.

Column 6, line 9, "e" should be ---the---.

Signed and Sealed this

Twentieth Day of March, 1990

*Attest:*

*Attesting Officer*

JEFFREY M. SAMUELS

*Acting Commissioner of Patents and Trademarks*